US011019877B2

(12) United States Patent
Battilana et al.

(10) Patent No.: US 11,019,877 B2
(45) Date of Patent: Jun. 1, 2021

(54) SPORT FOOTWEAR FOR PRACTICING WINTER SPORTS

(71) Applicant: Dalbello S.r.l., Casella d'Asolo (IT)

(72) Inventors: Carletto Battilana, Casella d'Asolo (IT); Rino Dal Bello, Asolo (IT)

(73) Assignee: Dalbello S.r.l., Casella d'Asolo (IT)

( * ) Notice: Subject to any disclaimer, the term of this patent is extended or adjusted under 35 U.S.C. 154(b) by 48 days.

(21) Appl. No.: 14/524,977

(22) Filed: Oct. 27, 2014

(65) Prior Publication Data

US 2015/0113832 A1 Apr. 30, 2015

(30) Foreign Application Priority Data

Oct. 25, 2013 (IT) ..... UD2013A000138

(51) Int. Cl.
*A43B 5/04* (2006.01)
*A43C 13/06* (2006.01)

(52) U.S. Cl.
CPC ..... *A43B 5/0486* (2013.01); *A43B 5/0401* (2013.01); *A43B 5/0423* (2013.01); *A43B 5/0482* (2013.01); *A43B 5/0484* (2013.01); *A43C 13/06* (2013.01)

(58) Field of Classification Search
CPC ..... A43C 13/06; A43C 13/36; A43B 5/0486; A43B 5/0401; A43B 5/0484; A43B 5/0482; A43B 5/0417; A43B 5/0411; A43B 5/0421; A43B 5/0423; A43B 5/0413; A43B 5/04; A43B 5/0415
USPC ..... 36/117.1, 117.2, 117.3, 87, 15, 112
See application file for complete search history.

(56) References Cited

U.S. PATENT DOCUMENTS 3,861,700 A * 1/1975 Fredriksen ..... A63C 9/20 280/615
3,965,586 A * 6/1976 Roosli ..... A43B 5/0419 36/7.3
4,078,322 A * 3/1978 Dalebout ..... A43B 5/04 36/10
4,108,467 A * 8/1978 Kreyenbuhl ..... A43B 5/0411 280/615

(Continued)

FOREIGN PATENT DOCUMENTS

DE 24 49 514 A1 4/1976
JP H04-51204 U 4/1992

OTHER PUBLICATIONS

Direct Plastics, "Why Choose Nylon 6 or Nylon 6.6," Mar. 26, 2013, https://www.directplastics.co.uk/about_plastics/why-choose-nylon-6-or-nylon-66.*

(Continued)

*Primary Examiner* — Jocelyn Bravo
(74) *Attorney, Agent, or Firm* — Calderone Bullock LLC

(57) ABSTRACT

Sport footwear for practicing winter sports comprising a shell (11) made of a first thermoplastic material and comprising a toe coupling projection (12) at the front and a heel coupling projection (13) at the back, configured to couple releasably to the bindings of a ski or snowboard. The sport footwear comprises at least a coupling projection protection cover (15, 16) releasably attached on at least one of, or both, said toe coupling projection (12) and heel coupling projection (13), and said at least one coupling projection protection cover (15,16) is made of a second thermoplastic material.

23 Claims, 2 Drawing Sheets

(56) References Cited

U.S. PATENT DOCUMENTS 4,133,119 A * 1/1979 Kubelka ..... A43B 5/0415 280/613
4,246,708 A * 1/1981 Gladek ..... A43B 5/10 36/107
4,269,430 A * 5/1981 Eie ..... A43B 5/0417 280/614
4,351,120 A * 9/1982 Dalebout ..... A43B 5/0419 36/117.3
4,499,674 A * 2/1985 Olivieri ..... A43B 5/0468 280/607
4,512,594 A * 4/1985 Eyre ..... A63C 9/001 280/614
4,542,599 A * 9/1985 Annovi ..... A43B 5/0419 36/117.4
4,562,653 A * 1/1986 Salomon ..... A63C 9/20 280/615
4,570,363 A * 2/1986 Annovi ..... A43B 5/0419 36/117.4
4,770,441 A * 9/1988 Demonsant ..... A63C 5/16 280/818
4,959,913 A * 10/1990 Provence ..... A43B 5/0411 280/615
4,982,515 A * 1/1991 Sartor ..... A43B 5/04 36/117.1
5,190,310 A * 3/1993 Hauglin ..... A63C 9/20 280/607
5,214,865 A * 6/1993 Sartor ..... A43B 5/0417 280/613
5,293,702 A * 3/1994 Miyoshi ..... A43B 5/0421 36/117.3
5,393,077 A * 2/1995 Wanous ..... A43B 5/0417 280/11.231
5,549,310 A * 8/1996 Meibock ..... A43B 5/0401 280/11.221
5,615,498 A * 4/1997 Challande ..... A43B 5/0417 36/117.1
5,918,386 A * 7/1999 Marmonier ..... A43B 5/0403 36/115
5,941,555 A * 8/1999 Dodge ..... A43B 5/0401 280/14.21
5,974,696 A * 11/1999 Aird ..... A43B 5/049 36/107
5,992,861 A * 11/1999 Piotrowski ..... A43B 5/0468 280/11.19
6,065,228 A * 5/2000 Begey ..... A43B 5/0417 36/117.3
6,076,285 A * 6/2000 Caeran ..... A43B 5/0401 36/115
6,145,868 A * 11/2000 Schaller ..... A63C 9/086 280/14.22
6,286,855 B1 * 9/2001 Paris ..... A43B 5/0417 280/608
6,315,305 B1 * 11/2001 Gien ..... A63C 10/22 280/11.26
6,389,712 B1 * 5/2002 Schelling ..... A43B 13/122 36/103
6,588,125 B2 * 7/2003 Proctor, Sr. ..... A43B 1/0018 36/117.1
6,598,317 B1 * 7/2003 Le Vine ..... A43B 5/12 36/15
6,609,313 B2 * 8/2003 Orso ..... A43B 5/0417 36/117.1
6,742,801 B1 * 6/2004 Dodge ..... A63C 10/10 280/14.22
6,868,624 B1 * 3/2005 Trinkaus ..... A43B 13/14 36/117.1
7,575,252 B2 * 8/2009 Smith ..... A43B 5/0401 280/14.21
7,779,559 B2 * 8/2010 Fenato ..... A43B 3/24 36/115
7,874,591 B2 * 1/2011 Korich ..... A63C 9/001 280/11.3
8,074,380 B2 * 12/2011 Narajowski ..... A43B 5/0452 36/117.3
8,424,226 B2 * 4/2013 Sartor ..... A43B 3/24 36/117.3
9,161,589 B2 * 10/2015 Parisotto ..... A43B 5/0494
2001/0013695 A1 * 8/2001 Borel ..... A43B 5/0403 280/607
2002/0000052 A1 * 1/2002 Orso ..... A43B 5/0417 36/117.3
2002/0062578 A1 * 5/2002 Lussier ..... A43B 5/02 36/59 R
2002/0088146 A1 * 7/2002 Joseph ..... A43B 5/04 36/117.3
2002/0162249 A1 * 11/2002 Barboux ..... A43B 5/0417 36/122
2005/0115117 A1 * 6/2005 Morlin ..... A43B 5/0417 36/117.3
2006/0064904 A1 * 3/2006 Confortin ..... A43B 5/04 36/117.1
2007/0204486 A1 * 9/2007 Fenato ..... A43B 3/24 36/117.1
2008/0184599 A1 * 8/2008 Ekberg ..... A43B 5/0417 36/117.3
2009/0113763 A1 * 5/2009 Narajowski ..... A43B 5/0452 36/117.3
2009/0255149 A1 * 10/2009 Rigat ..... A43B 1/0018 36/117.3
2010/0115798 A1 * 5/2010 Sartor ..... A43B 3/24 36/117.3
2010/0257754 A1 * 10/2010 Trabucchi ..... A43B 5/0413 36/117.1
2012/0042542 A1 * 2/2012 Lehner ..... A43B 5/0417 36/117.1
2013/0283643 A1 * 10/2013 Rosato ..... A43B 3/246 36/117.3

OTHER PUBLICATIONS

European Search Report and Annex from European counterpart Application No. 14190232, (dated Apr. 23, 2015 3 pages).
Italian Patent Office Search Report, dated May 23, 2014 (2 pages).

* cited by examiner

SPORT FOOTWEAR FOR PRACTICING WINTER SPORTS

BACKGROUND OF THE INVENTION

Field of the Invention

The present invention concerns sport footwear for practicing winter sports, such as for example a ski boot, a snowboard boot or similar sports equipment, in which a substantially closed and impermeable structure, called shell, made of a first material, defines a compartment to receive and position the user's foot.

Description of Related Art

Sport footwear for winter sports, such as ski boots, snowboard boots or suchlike are known, which comprise a substantially closed structure at the side and bottom. The structure is commonly known as the shell, and can be made by molding relatively "soft" polymer materials, such as polyethylene or similar polyolefins in general, which are deformable and flexible enough to follow and adapt to the movement of a user's foot and ankle, supplying the required comfort.

Such polyolefin-based materials are generally economical and considered "poorer" materials than others with better mechanical properties, such as polyurethane.

The lower parts of the shell, in correspondence with the heel and the toe, commonly comprise flaps or coupling projections, rear and front, suitable to be selectively attached to ski or snowboard bindings.

The coupling projections must consequently be suitable to resist wear due to mechanical stresses that occur when the ski or snowboard is used, in particular due to the clamping action of the bindings and, at the same time, to facilitate the sliding/running of the coupling projections inside the bindings. The mechanical coupling of the heel and toe coupling projections and the bindings is so important that specific regulations are dedicated to these zones, to ensure the mechanical grip of the parts, to such an extent that in this technical field, the region of the heel and toe coupling projections is the one subject to the strictest regulations.

Sport footwear for practicing winter sports is known, which provides reinforcement elements, stably attached or made on the shell near the heel and toe, made of a material with high properties of mechanical resistance, in particular resistance to wear, such as polyurethane. The reinforcement elements can be made by autonomous molding with respect to the shell, or attached by suitable known attachment means, such as screws or joint mechanisms. The reinforcement elements are associated to the bindings of the ski or snowboard.

One disadvantage of these embodiments is that the reinforcement elements and the corresponding attachment means increase the overall weight of the sport footwear, which can entail a disadvantage for the user in terms of possible poorer performance and loss of balance, or because a greater weight of the footwear can impede movement.

Another disadvantage of these embodiments is that the reinforcement elements can lead to raising the barycenter of the combined sport footwear/ski or snowboard, leading to a reduction in stability for the user.

Boots are also known in which the polyethylene shell and the polyurethane reinforcement elements are made in a single body by a hot co-molding process.

One disadvantage of such boots is that polyurethane and polyethylene are incompatible materials in terms of chemical-physical properties, for example they have different coefficients of heat dilation, and consequently can deform in a non-uniform and unpredictable manner, bringing the risk of the boot becoming detached from the movement member.

Another disadvantage of these embodiments is that molding the reinforcement elements can lead to burrs or to the formation of discard material. In particular, burrs and the formation of discard materials that are very precious and expensive, like polyurethane, lead to economic losses for the production companies.

Furthermore, there is a need to reduce the production costs of the sport footwear in question, while maintaining good mechanical properties, comfort and performance. In particular, there is a need to reduce to a minimum the use of "precious" materials, such as polyurethane, exploiting to the utmost more economical materials, such as polyolefins.

U.S. Pat. No. 4,351,120 describes a ski boot provided with traction components that have traction surfaces with various characteristics, depending on the type of use, which can be mounted interchangeably using snap-in clamping elements. These interchangeable components develop mainly in the lower part of the ski boot which rests on the ground during use and, since they are provided to define traction surfaces, they must be made of materials suitable for this purpose; however, these are not suitable in terms of rigidity and resistance to support the mechanical stresses and wear due to the action of the bindings clamping the sport equipment. U.S. Pat. No. 5,615,498, DE-A-2449514 and US-A-2002/000052 describe other ski boots of a known type.

There therefore exists a need to perfect sport footwear for practicing winter sports that can overcome at least one of the shortcomings of the state of the art.

In particular, one purpose of the present invention is to obtain sport footwear for practicing winter sports, such as ski boots, snowboard boots or suchlike, which fully satisfies the requirements of mechanical grip and sliding of the region of the heel and toe coupling projections but which at the same time can be produced at lower cost, in particular in terms of raw plastic materials. In particular, there is a strongly felt need to make the shell in a light plastic material but which, in the zones of contact with the bindings or coupling projections, has properties of high mechanical resistance, in particular resistance to wear, more particularly to the wear deriving from the stresses of the bindings clamping the sports equipment, and which at the same time facilitates the sliding inside the bindings.

Another purpose of the present invention is to obtain sport footwear with a lower weight and which allows to keep a low barycenter of the combined sport footwear/ski or snowboard.

The Applicant has devised, tested and embodied the present invention to overcome the shortcomings of the state of the art and to obtain these and other purposes and advantages.

BRIEF SUMMARY OF THE INVENTION

The present invention is set forth and characterized in the independent claims, while the dependent claims describe other characteristics of the invention or variants to the main inventive idea.

In accordance with the above purposes, the present invention concerns sport footwear for practicing winter sports such as for example a ski boot, a snowboard boot or similar sports equipment.

The sport footwear comprises a shell to receive the user's foot. The shell is made of a first thermoplastic material, and comprises a front toe portion and a back heel portion. The shell is closed at the lower part by a sole. The shell also comprises at the front a toe coupling projection and at the back a heel coupling projection, configured to couple releasably to the bindings of a ski or snowboard.

The sport footwear comprises at least a coupling projection protection cover or cap, releasably attached on at least one or on both of said toe coupling projection and heel coupling projection, said at least one coupling projection protection cover being made of a second thermoplastic material different from and with greater mechanical resistance than said first thermoplastic material.

The present invention allows to make the shell in the first thermoplastic material, which is "soft" and economical, since it is chosen for this purpose and has properties of flexibility or deformability as well as lightness, thus facilitating the movements of the user's foot. The invention also allows to make the coupling projection protection cover in the second thermoplastic material, more precious in mechanical terms, in particular more resistant to wear, at the same time allowing an adequate sliding with respect to the bindings. In this way the invention allows to use as little of the second thermoplastic material as possible, without negatively affecting—and indeed, fully satisfying—the requirements typically laid down for the region of the heel and toe coupling projections.

In particular, the coupling projection protection covers are typically made autonomously from the shell, for example by molding, thus reducing possible disadvantages deriving from co-molding with the shell.

In some forms of embodiment, the sport footwear comprises at least a heel contact plate releasably attached to the lower part of the sole in the heel portion and/or a toe contact plate releasably attached to the lower part of the sole in the toe portion. The at least one coupling projection protection cover is releasably connected between a respective heel contact plate and/or toe contact plate and a lower part of the sole in the respective toe portion and/or heel portion.

In some forms of embodiment, the front toe portion and the rear heel portion are integral and in a single piece with the shell, including respectively the toe coupling projection and the heel coupling projection.

In some forms of embodiment, the first thermoplastic material is chosen from a group comprising a polyolefin, a blend of polyethylene with other polymers or additives, a toughened polyethylene or another polymer material containing at least one type of polyethylene.

Generally these materials have an optimal compromise between elasticity, softness, appearance and economy of transforming the materials.

In particular, toughened polyethylenes can have properties of greater resistance, especially at low temperatures, and an appropriate elastic modulus.

In some forms of embodiment, the second material can be chosen between a polyurethane-based material or a polyamide-based material. These materials are particularly resistant to wear and at the same time allow the coupling projections to slide inside the bindings.

In some forms of embodiment the thickness of the cover can be comprised between 0.5 mm and 5 mm, more preferably between 1 mm and 3 mm.

The reduced thickness of the covers allows to reduce the overall weight of the sport footwear and at the same time to reduce the quantity of second material used compared to known forms of embodiment.

Using covers with reduced thickness also allows to keep the barycenter of the combined sport footwear/movement member low, even if the cover is even partly positioned between shell and movement member.

In one form of embodiment, the at least one coupling projection protection cover is configured to cover exclusively an upper and/or lateral part of one, the other or both said toe coupling projection and heel coupling projection, providing at the lower part only attachment portions to the shell.

The present invention also concerns a method to make sport footwear for practicing winter sports, comprising:

- molding a shell to receive a user's foot, using a first thermoplastic material, making a front toe portion and a back heel portion, a toe coupling projection being provided at the front and a heel coupling projection being provided at the back, configured to couple releasably with the bindings of a ski or snowboard;
- making available at least a coupling projection protection cover made of a second thermoplastic material, different from and having greater mechanical resistance than said first thermoplastic material,
- the releasable attachment of said at least one coupling projection protection cover on at least one of, or on both of, said toe coupling projection and said heel coupling projection.

These and other aspects, characteristics and advantages of the present disclosure will be better understood with reference to the following description, drawings and attached claims. The drawings, which are integrated and form part of the present description, show some forms of embodiment of the present invention, and together with the description, are intended to describe the principles of the disclosure.

The various aspects and characteristics described in the present description can be applied individually where possible. These individual aspects, for example aspects and characteristics described in the attached dependent claims, can be the object of divisional applications.

It is understood that any aspect or characteristic that is discovered, during the patenting process, to be already known, shall not be claimed and shall be the object of a disclaimer.

BRIEF DESCRIPTION OF THE SEVERAL VIEWS OF THE DRAWINGS

These and other characteristics of the present invention will become apparent from the following description of some forms of embodiment, given as a non-restrictive example with reference to the attached drawings wherein.

Figure 1:
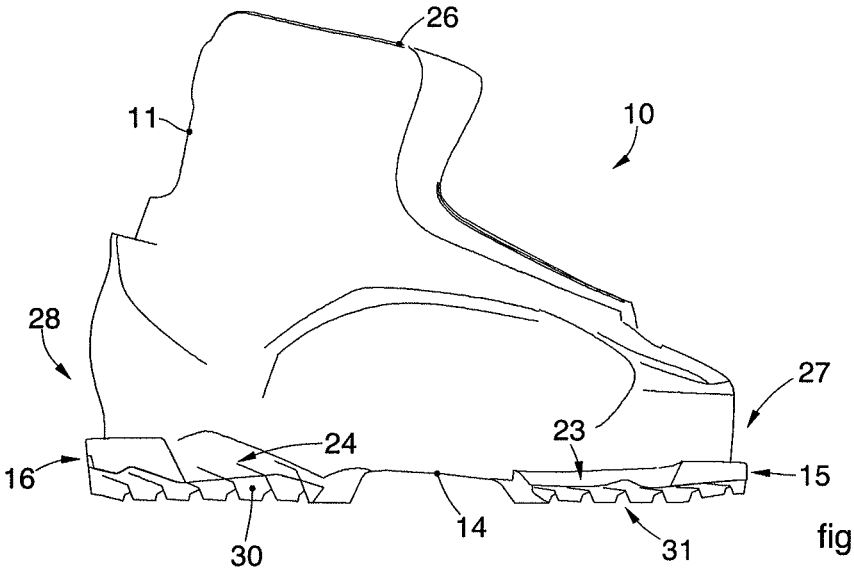
FIG. 1 is a lateral view of some forms of embodiment of the sport footwear for practicing winter sports according to the present invention.

To facilitate comprehension, the same reference numbers have been used, where possible, to identify identical common elements in the drawings. It is understood that elements and characteristics of one form of embodiment can conveniently be incorporated into other forms of embodiment without further clarifications.

DETAILED DESCRIPTION OF THE INVENTION

We shall now refer in detail to the various forms of embodiment of the present invention, of which one or more examples are shown in the attached drawings. Each example is supplied by way of illustration of the invention and shall not be understood as a limitation thereof. For example, the characteristics shown or described insomuch as they are part of one form of embodiment can be adopted on, or in association with, other forms of embodiment to produce another form of embodiment. It is understood that the present invention shall include all such modifications and variants.

FIG. 1 is used to describe forms of embodiment of sport footwear 10 for practicing winter sports, such as for example a ski boot, a snowboard boot or similar sports equipment.

The sport footwear 10 comprises a shell 11 configured to receive a user's foot. Typically, the shell is made of a first thermoplastic material.

In some forms of embodiment, the shell 11 is shaped, for example by a molding step, for example typically by injection, so as to define a compartment 25 (FIG. 2), which has shape and sizes suitable to contain the user's foot.

In some forms of embodiment, the shell 11 can be closed at the lower part by a sole 14, and at the sides it can be impermeable to water and can have an upper aperture 26, in correspondence with which closing elements of a known type are suitable to be disposed, not shown in the drawings.

The first thermoplastic material can be chosen for example from the group comprising polyolefins, in particular polyethylene, or a blend of polyethylene with other polymers or additives, a toughened polyethylene or another polymer material containing at least one type of polyethylene.

In particular, toughened polyethylenes can have properties of greater resistance, especially at low temperatures, and an appropriate elastic modulus. Examples of polyethylene or blends of polyethylene usable for the shell 11 include elastomer compounds containing thermoplastic block copolymers, such as styrenic block copolymers, for example SBS, SEBS, SEPS, such as Megol® (TPE-SEBS) or Marfran® (TPE-SBS) or other type, such as Apigo® (TPE-TPO). These materials have an optimal compromise between elasticity, softness, appearance and economy in transforming the materials.

In some forms of embodiment, the shell 11 can comprise a front toe portion 27 and a rear heel portion 28.

In some forms of embodiment, at the front the shell 11 can comprise a toe coupling projection 12, or front tongue or nose, and at the rear a heel coupling projection 13, or rear tongue or tail, configured to couple releasably with the bindings of a ski or snowboard, in particular defining members for the connection, for example by clamping, with bindings to the sports equipment.

In possible implementations, the front toe portion 27 and the rear heel portion 28 are integral and in a single piece with the shell 11, including respectively the toe coupling projection 12 and the heel coupling projection 13.

In other forms of embodiment, the shell 11 can comprise a single coupling projection 12, 13, positioned in correspondence with the toe portion 27 or the heel portion 28, for example in relation to the type of sport or application of the sport footwear 10.

In forms of embodiment described with reference to FIG. 1, the sport footwear 10 comprises at least one coupling projection protection cover, or cap, in this case a first coupling projection protection cover 15 and a second coupling projection protection cover 16, each of which can be configured to be releasably attached on at least one of said coupling projections 12, 13.

In some forms of embodiment, the first coupling projection protection cover 15 and the second coupling projection protection cover 16 can be made of a second thermoplastic material, different from and with a greater mechanical resistance than the first thermoplastic material.

The second material is such as to be able to resist wear, and has a high mechanical resistance to stresses extending over time and a high level of hardness.

Furthermore, the second material is preferably configured to facilitate sliding inside the bindings, having microscopic characteristics such as to reduce friction with the materials that the bindings are made of.

In some forms of embodiment, the second material is chosen from a group comprising a polyurethane-based or polyamide-based material. The polyamide-based material can typically be aliphatic or semi-aromatic polyamide, that is, nylon, such as polyamide 6 (PA 6), or polyamide 66 (PA 66), polyamide 610 (PA 610), polyamide 612 (PA 612) or also polyamide 12 (PA 12).

In some forms of embodiment, it is possible to use blends or engineered compounds with a polyamide base, such as for example Schulamid® 6, Schulamid® 66, Schulamid® 610, Schulamid® 612 or Schulamid® 12. Another example of a product that can be used is a compound with a polyamide 6 base reinforced with fiberglass, for example 30% in weight of fiberglass, such as Schulamid® 6 GF 30 TC.

In some forms of embodiment the sport footwear 10 can comprise a single coupling projection protection cover 15, 16, positioned for example in correspondence with the toe coupling projection 12 or the heel coupling projection 13, that is, in correspondence respectively with the toe portion 27 or the heel portion 28.

In some forms of embodiment, the sport footwear 10 can also comprise a heel contact plate 30 and a toe contact plate 31, configured to be positioned during use between the sport footwear 10 and the movement member, and to stabilize the reciprocal adhesion thereof. In particular, the heel contact plate 30 and the toe contact plate 31 can function as interaction components between the sport footwear 10 and the movement member, for example in the case of sports practice, in particular skiing, or between the sport footwear 10 and the ground on which the user proceeds, for example when walking.

In some forms of embodiment, the heel contact plate 30 can be attached releasably below the sole 14 in the heel portion 28. In some forms of embodiment, moreover, the toe contact plate 31 can be attached releasably below the sole 14 in the toe portion 27.

In some forms of embodiment, the at least one coupling projection protection cover 15, 16, or possibly the two coupling projection protection covers 15, 16 can be releasably connected between a respective heel contact plate 30 and/or toe contact plate 31 and a lower part of the respective toe portion 27 and/or heel portion 28. In particular, attachment portions 32 of the coupling projection protection covers 15, 16 can be provided, disposed between a respective heel contact plate 30 and toe contact plate 31 and a lower part of the respective toe portion 27 and heel portion 28 (see for example FIGS. 2, 3, 6 and 7).

In forms of embodiment described with reference to FIGS. 2-5, the sport footwear 10 can comprise releasable attachment members 17 of the at least one coupling projection protection cover 15, 16 to the shell 11.

In particular, the releasable attachment members 17 can be chosen from the group comprising screws 18 (FIGS. 2-5), pegs, pins or joint elements.

Figure 2:
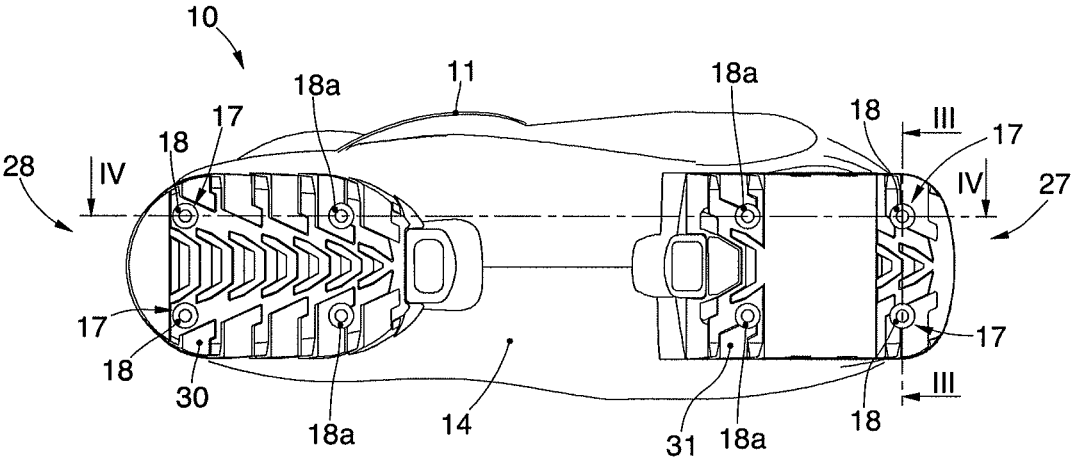
FIG. 2 is a view from below of some forms of embodiment of the sport footwear according to the present invention.

In forms of embodiment described with reference to FIG. 2, the releasable attachment members 17 can also be configured to attach the contact plates 30, 31 to the sole 14. In fact, for example the screws 18 that can function as releasable attachment members 17 can be positioned on the sole 14 of the shell 11, allowing to constrain the contact plates 30, 31 at the same time (FIGS. 2-5).

In possible implementations, auxiliary screws 18*a* may also be provided, to complete the attachment of the contact plates 30, 31 to the sole 14 (FIGS. 2-5).

In forms of embodiment described with reference to FIGS. 3 and 4, at least one coupling projection protection cover 15, 16 has a concave seating 21 configured to be coupled with, and to receive inside it, a mating convex profile 22 provided on the toe coupling projection 12 and/or on the heel coupling projection 13.

Figure 3:
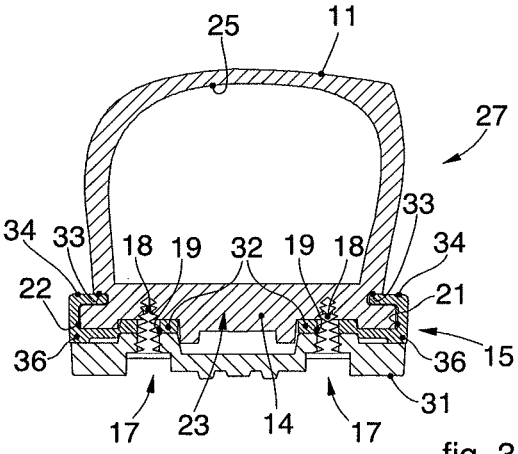
FIG. 3 is a section view from III to III in FIG. 2.
Figure 4:
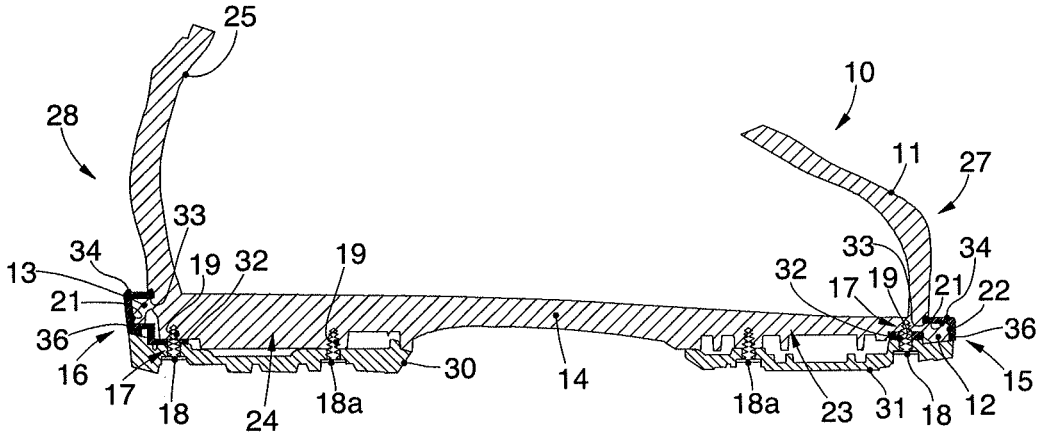
FIG. 4 is a section view from IV to IV in FIG. 2.

FIGS. 3 and 4 show forms of embodiment of the present invention in which the screws 18 are coupled with holes 19 passing through at least the coupling projection protection covers 15 16 and through the shell 11.

In particular, the coupling projection protection covers 15, 16 can comprise the attachment portions 32, configured to allow the attachment of the coupling projection protection covers 15, 16 to the shell 11 by means of the releasable attachment members 17, in particular the screws 18.

For example, in the forms of embodiment shown in FIGS. 3 and 4, the attachment portions 32 are positioned in contact with the sole 14, that is, on the lower part of the shell 11. In these embodiments, the holes 19 can be provided on the sole 14, which allows to hide the screws 18 when the sport footwear 10 is worn by a user.

In some forms of embodiment, the thickness of the at least one coupling projection protection cover 15, 16 is comprised between 0.5 mm and 5 mm, in particular between 1 mm and 3 mm.

The reduced thickness of the coupling projection protection covers 15 and 16 allows, in the case where the attachment portions 32 are positioned in contact with the sole 14, to keep the barycenter of the combined sport footwear 10/ski or snowboard low, when the sport footwear 10 and the ski or snowboard are coupled.

The reduced thickness of the coupling projection protection covers 15 and 16 also allows to reduce the overall weight of the sport footwear 10, even if a second material is used with a particularly high density, like some polyurethane-based or polyamide-based materials.

With reference to FIGS. 3 and 4, the holes 19 can pass not only through the coupling projection protection covers 15, 16 and the shell 11, but also the contact plates 30, 31, allowing to attach the latter by means of screws 18.

In variant forms of embodiment, not shown, the holes 19 can be made for example on the convex profile 22 of the coupling projections 12, 13.

In forms of embodiment described with reference to FIG. 5, the coupling projection protection covers 15, 16 can have an external profile 36 which can have a shape mating with the respective shape of the toe coupling projection 12 or heel coupling projection 13.

The external profile 36 can laterally surround the respective toe coupling projection 12 or heel coupling projection 13, and can have a covering wall or roof 34, transverse, in particular perpendicular, to the external profile 36, able to cover and protect the respective toe coupling projection 12 or heel coupling projection 13 from above.

For example, the external profile 36 can be U-shaped, for example it can be a U-shaped wall. The toe portion 27 and the heel portion 28 can have fissures or grooves 33, mating with the covering walls 34 of the coupling projection protection covers 15, 16.

In this way, the fissures or grooves 33 are configured mating with the covering walls 34, to allow a reciprocal coupling and hence a stable connection to the zone of the toe coupling projection 12 and the heel coupling projection 13.

In other forms of embodiment, the external profile 36 can comprise rectilinear segments and/or curved segments in alternation.

In forms of embodiment described with reference to FIG. 5, the attachment portions 32 are reduced in size, in order to further limit the overall weight of the coupling projection protection covers 15, 16.

In this case, the attachment portions 32 have a laminar or plate-like form and comprise first holes 19*a* mating in size with the shape of the screws 18. In particular, the attachment portions 32 can protrude or project toward the inside with respect to the external profile 36. For example, the attachment portions 32 can be made as eyelets or annular portions, which have the first holes 19*a* inside them.

The holes 19 are made up in their entirety by the first holes 19*a*, second holes 19*b*, comprised in the shell 11, and third holes 19*c* comprised in the contact plate 30, 31 (FIGS. 3-4).

In forms of embodiment according to FIGS. 1, 3, 4 and 5, the shell 11 can comprise support structures 23, 24 configured for the attachment of the coupling projection protection covers 15, 16 and/or the contact plates 30, 31.

Figure 5:
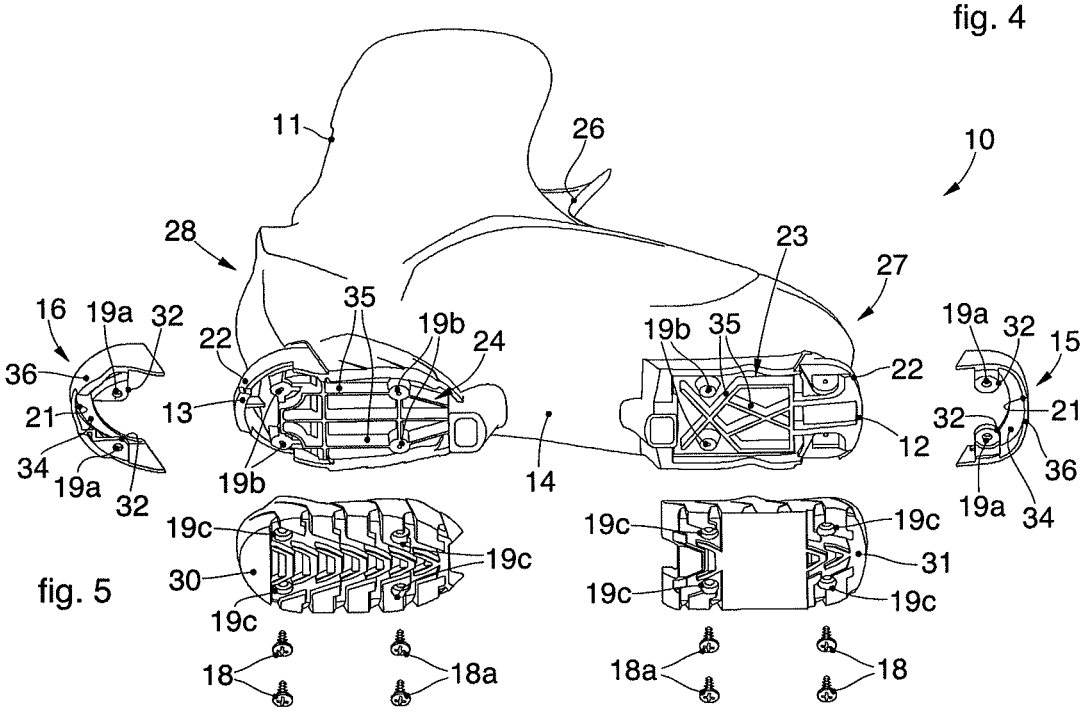
FIG. 5 is a perspective view in separate parts of forms of embodiment of the sport footwear according to the present invention.

With reference to FIG. 5, a first support structure 23 can be provided for example in correspondence with the toe portion 27, and a second support structure 24, in correspondence with the heel portion 28. The first support structure 23 and the second support structure 24 are associated with the sole 14 of the shell 11, in particular made protruding from the sole 14 in correspondence respectively with the lower part of the toe portion 27 and the heel portion 28. As described with reference to FIG. 5, the coupling projection protection covers 15, 16 can be provided respectively between the first support structure 23 and the second support structure 24 and the heel contact plate 30 and the toe contact plate 31.

The support structures 23, 24 can comprise structural ribs 35 configured to structurally support the coupling projection protection covers 15,16 and support the weight of a user.

Figure 6:
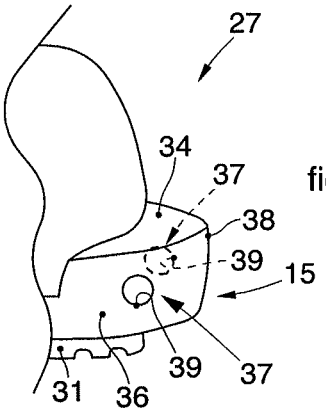
FIG. 6 is a perspective view of a detail of forms of embodiment of the sport footwear according to the present invention.
Figure 7:
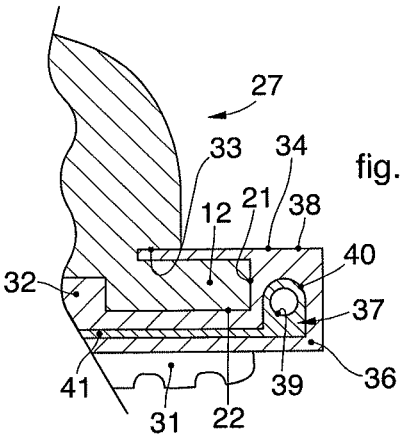
FIG. 7 is a section view of a detail of form of embodiment of the sport footwear according to the present invention.

In other forms of embodiment described using FIGS. 6 and 7, the first coupling projection protection cover 15 can comprise coupling means 37 for Alpine skiing, that is, configured to be coupled with bindings for Alpine skiing, for example making a binding commonly known as Dynafit®.

The coupling means 37 for Alpine skiing, such as for example the Dynafit® type or similar or comparable, in particular provide to maintain the toe coupling projection 12 pivoted to the ski, allowing to raise the heel portion 28 of the sport footwear 10, by means of a rotatory movement, thus facilitating the movement required in Alpine skiing.

In some forms of embodiment, the coupling means 37 for Alpine skiing can be integrated in an attachment portion 38 provided at the front of the first coupling projection protection cover 15.

In particular, the coupling means 37 for Alpine skiing can comprise two coupling cavities 39 made laterally, in particular in an opposite position, on the attachment portion 38 of the first coupling projection protection cover 15.

In some forms of embodiment, the coupling cavities 39 can be made on attachment blocks 40, for example comprised in a strengthening plate 41, for example metal, which can provide the necessary structure and resistance (for example see FIG. 7).

In other possible forms of embodiment, the coupling cavities 39 can be made on a metal bar inserted transversely in the attachment portion 38.

In possible forms of embodiment, the metal plate 41 or the metal bar can be inserted, drowned or incorporated inside the first coupling projection protection cover 15, for example during molding.

It is clear that modifications and/or additions of parts may be made to the sport footwear for practicing winter sports as described heretofore, without departing from the field and scope of the present invention.

It is also clear that, although the present invention has been described with reference to some specific examples, a person of skill in the art shall certainly be able to achieve many other equivalent forms of sport footwear for winter sports, having the characteristics as set forth in the claims and hence all coming within the field of protection defined thereby.

Although the above description refers to forms of embodiment of the invention, other forms of embodiment can be provided but this does not distance it from its main field of protection, and its field of protection is defined by the claims that follow.

It will be appreciated by those skilled in the art that changes could be made to the embodiments described above without departing from the broad inventive concept thereof. It is understood, therefore, that this invention is not limited to the particular embodiments disclosed, but it is intended to cover modifications within the spirit and scope of the present invention as defined by the appended claims.

We claim:

1. An article of footwear for practicing winter sports, the article of footwear comprising:

a shell to receive a user's foot, the shell made of a first thermoplastic material, the shell comprising a front toe portion and a back heel portion, said shell including a sole at a lower part of the shell, said shell comprising a toe coupling projection extending integrally and outwardly in a transverse direction from the front toe portion of the shell, and a heel coupling projection extending integrally and outwardly in a transverse direction from the back heel portion of the shell, wherein each of the toe coupling projection and the heel coupling projection are configured to indirectly engage bindings of a ski or snowboard, wherein the first thermoplastic material is selected from a group consisting of: polyolefins, blends of polyolefins with other polymers or additives, toughened polyolefins, and another polymer material containing at least one type of polyolefin, wherein the sport footwear further comprises:

at least one contact plate including one or both of a heel contact plate and a toe contact plate, wherein the at least one contact plate is releasably attached to a lower part of the sole in one or both of the heel portion and the toe portion; and at least one coupling projection protection cover releasably attached on one or on both of said toe coupling projection and said heel coupling projection, wherein said at least one coupling projection protection cover is configured to directly engage bindings of a ski or snowboard;

wherein the at least one coupling projection cover is made of a second thermoplastic material, wherein the second thermoplastic material is a polyurethane-based or polyamide-based material, wherein said second material is different from and has greater mechanical resistance than said first thermoplastic material, wherein said at least one coupling projection protection cover is releasably connected between the lower part of the sole and the at least one contact plate, in one or both of the respective toe portion and heel portion, and wherein an upper part of one or both of the toe coupling projection and heel coupling projection is covered by the at least one coupling projection protection cover.

2. The article of footwear as in claim 1, wherein said front toe portion and said back heel portion are integral and in a single piece with said shell, including said toe coupling projection and said heel coupling projection.

3. The article of footwear as in claim 1, wherein the second thermoplastic material is a polyamide-based material, and wherein the polyamide-based material is chosen from a group consisting of: aliphatic or semi-aromatic polyamide, engineered blends or compounds with a polyamide base, and a compound with a polyamide base reinforced with fiberglass.

4. The article of footwear as in claim 3, wherein the polyamide-based material is chosen from a group consisting of: polyamide 6, or polyamide 66, polyamide 610, polyamide 612 or polyamide 12, and a compound with a polyamide 6 base reinforced with fiberglass.

5. The article of footwear as in claim 3, wherein the polyamide-based material is a polyamide 6 base reinforced with 30% in weight of fiberglass.

6. The article of footwear as in claim 1, wherein said at least one coupling projection protection cover has a concave seating configured to be coupled with, and to receive inside the concave seating, a mating convex profile provided on one or both of the toe coupling projection and the heel coupling projection.

7. The article of footwear as in claim 1, wherein a thickness of the at least one coupling projection protection cover is between 0.5 mm and 5 mm.

8. The article of footwear as in claim 7, wherein the thickness of the at least one coupling projection protection cover is between 1 mm and 3 mm.

9. The article of footwear as in claim 1, wherein the article of footwear comprises releasable attachment members for releasable attachment of the at least one coupling projection protection cover to the shell.

10. The article of footwear as in claim 9, wherein the releasable attachment members are chosen from a group consisting of: screws, pegs, pins, and other joint elements.

11. The article of footwear as in claim 9, wherein the at least one contact plate comprises both the heel contact plate and the toe contact plate, and the releasable attachment members are also configured to attach the heel contact plate and the toe contact plate to the shell.

12. The article of footwear as in claim 9, wherein the releasable attachment members are screws coupled to holes passing at least through the at least one coupling projection protection cover and through the shell.

13. The article of footwear as in claim 12, wherein the at least one contact plate comprises both the heel contact plate and the toe contact plate, and the holes pass through the at least one coupling projection protection cover, the shell, the heel contact plate, and the toe contact plate, allowing attachment of the heel contact plate and the toe contact plate to the at least one coupling projection protection cover by the screws.

14. The article of footwear as in claim 9, wherein the at least one coupling projection protection cover comprises attachment portions configured to allow attachment to the shell by the releasable attachment members.

15. The article of footwear as in claim 1, wherein the at least one coupling projection protection cover comprises a U-shaped external profile.

16. The article of footwear as in claim 1, wherein the article of footwear is for Alpine skis and has a coupling means for Alpine skis configured to be coupled with bindings for Alpine skis, and wherein the coupling means are provided at the at least one coupling projection protection cover, wherein the at least one coupling projection protection cover is releasably attached to said toe coupling projection.

17. The article of footwear as in claim 16, wherein the coupling means for Alpine skiing are integrated in an attachment portion provided at a front of the at least one coupling projection protection cover on the toe coupling projection, and the coupling means comprise two coupling cavities made laterally in an opposite position on the attachment portion of the at least one coupling projection protection cover, wherein the coupling cavities are made within attachment blocks of a strengthening plate, or the coupling cavities are defined by a metal bar inserted transversely in the attachment portion.

18. The article of footwear as in claim 1, wherein a lateral part of one or both of the toe coupling projection and heel coupling projection is exclusively covered by the at least one coupling projection protection cover, and wherein a lower part of the at least one coupling projection protection cover comprises attachment portions to the shell.

19. The article of footwear as in claim 1, wherein the at least one coupling projection protection cover includes a first coupling projection protection cover and a second coupling projection protection cover, wherein the first coupling projection protection cover is for the toe coupling projection and the second coupling projection protection cover is for the heel coupling projection.

20. The article of footwear as in claim 1, wherein the at least one contact plate comprises both the heel contact plate and the toe contact plate, and wherein the article of footwear further includes a first support structure in correspondence to the toe portion and a second support structure in correspondence to the heel portion, to which the heel contact plate and the toe contact plate are respectively connected, wherein said at least one coupling projection protection cover is provided between the first support structure and the toe contact plate, and between the second support structure and the heel contact plate and the toe contact plate.

21. A method to make the article of footwear for practicing winter sports of claim 1, said method comprising:

molding the shell to receive the user's foot, using the first thermoplastic material, making the front toe portion and the back heel portion, the toe coupling projection being provided at the front toe portion of the shell and the heel coupling projection being provided at the back heel portion of the shell, making available said at least one coupling projection protection cover made of said second thermoplastic material, different from and having greater mechanical resistance than said first thermoplastic material, and releasably attaching said at least one coupling projection protection cover on at least one of said toe coupling projection and said heel coupling projection, so that when the at least one coupling projection protection cover is attached, at least one of an upper art and a lateral part of one or both of the toe coupling projection and heel coupling projection is covered by the at least one coupling projection protection cover.

22. The article of footwear as in claim 1, wherein the first material is chosen from a group consisting of: a polyethylene, a blend of polyethylene with other polymers or additives, a toughened polyethylene, and another polymer material containing at least one type polyethylene.

23. An article of footwear for practicing winter sports, the article of footwear comprising:

a shell to receive a user's foot, the shell made of a first thermoplastic material, the shell comprising a front toe portion and a back heel portion, said shell including a sole at a lower part of the shell, said shell comprising a toe coupling projection extending integrally and outwardly in a transverse direction from the front toe portion of the shell, and a heel coupling projection extending integrally and outwardly in a transverse direction from the back heel portion of the shell, wherein each of the toe coupling projection and the heel coupling projection are configured to indirectly engage the bindings of a ski or snowboard, wherein the first thermoplastic material is selected from a group consisting of: polyolefins, blends of polyolefins with other polymers or additives, toughened polyolefins, and another polymer material containing at least one type of polyolefin, wherein the sport footwear further comprises:

at least one contact plate including one or both of a heel contact plate and a toe contact plate, wherein the at least one contact plate is releasably attached to a lower part of the sole in one or both of the heel portion and the toe portion; and at least one coupling projection protection cover releasably attached on one or on both of said toe coupling projection and said heel coupling projection, wherein said at least one coupling projection protection cover is configured to directly engage bindings of a ski or snowboard and the at least one coupling projection cover is made of a second thermoplastic material, wherein the second thermoplastic material is a polyurethane-based or polyamide-based material, wherein said second material is different from and has greater mechanical resistance than said first thermoplastic material, wherein said at least one coupling projection protection cover is releasably connected between the lower part of the sole and the at least one contact plate, in one or both of the respective toe portion and heel portion, and wherein the at least one coupling projection protection cover comprises a concave seating configured to receive a mating convex profile on at least one of the toe coupling projection and the heel coupling projection, the at least one couple coupling projection protection cover comprising attachment portions that each extend laterally inwardly from lateral edges of the concave seating, wherein the attachment portions are separated by a central laterally extending gap and the attachment portions receive releasable attachment members for releasably coupling the at least one coupling projection protection cover to at least one of the toe coupling projection and the heel coupling projection.

* * * * *